United States Patent [19]

Hall et al.

[11] Patent Number: 4,501,035

[45] **Date of Patent: * Feb. 26, 1985**

[54] SELF-SEALING WATERBED MATTRESS

[75] Inventors: Charles P. Hall, Muir Beach; Joseph Philipson, Pasadena, both of Calif.

[73] Assignee: Monterey Manufacturing Co., Carson, Calif.

[ * ] Notice: The portion of the term of this patent subsequent to May 10, 2000 has been disclaimed.

[21] Appl. No.: 421,369

[22] Filed: Sep. 22, 1982

Related U.S. Application Data

[63] Continuation of Ser. No. 134,628, Mar. 27, 1980, Pat. No. 4,382,305.

[51] Int. Cl.[3] ..... A47C 27/08

[52] U.S. Cl. ..... 5/451; 428/912

[58] Field of Search ..... 5/451, 452, 449, 450; 428/912; 152/347, DIG. 5; 156/115

[56] References Cited

U.S. PATENT DOCUMENTS

| | | | |
|---|---|---|---|
| 3,421,163 | 1/1969 | Stoughton | 5/449 |
| 3,574,873 | 4/1971 | Weinstein | 5/451 X |
| 3,664,904 | 5/1972 | Cook | 428/912 X |
| 3,736,974 | 6/1973 | Carson, Jr. . | |
| 3,742,531 | 7/1973 | Allsbury . | |
| 3,761,974 | 10/1973 | Kuss . | |
| 3,952,787 | 4/1976 | Okado et al. | 428/912 X |
| 3,981,342 | 9/1976 | Farber et al. | 428/912 X |
| 4,057,090 | 11/1977 | Hoshikawa et al. | 428/912 X |
| 4,145,780 | 3/1979 | Fogel . | |
| 4,149,286 | 4/1979 | Fogel . | |
| 4,171,237 | 10/1979 | Bohm et al. | 428/912 X |
| 4,192,031 | 3/1980 | Fogel . | |

OTHER PUBLICATIONS

Vinyl Products Advertisement, two pages, 1979.

*Primary Examiner*—George A. Suchfield
*Attorney, Agent, or Firm*—Jeffrey G. Sheldon

[57] ABSTRACT

A waterbed mattress comprising an external envelope is provided with an internal layer of viscous, polymeric sealing material for sealing punctures in the mattress. The polymeric material can be polybutene filled with a particulate filler. The sealing material can be sandwiched between two layers of polyethylene to form an internal liner assembly that conforms generally to the shape of the external envelope of the waterbed mattress.

4 Claims, 2 Drawing Figures

SELF-SEALING WATERBED MATTRESS

Figure 1:
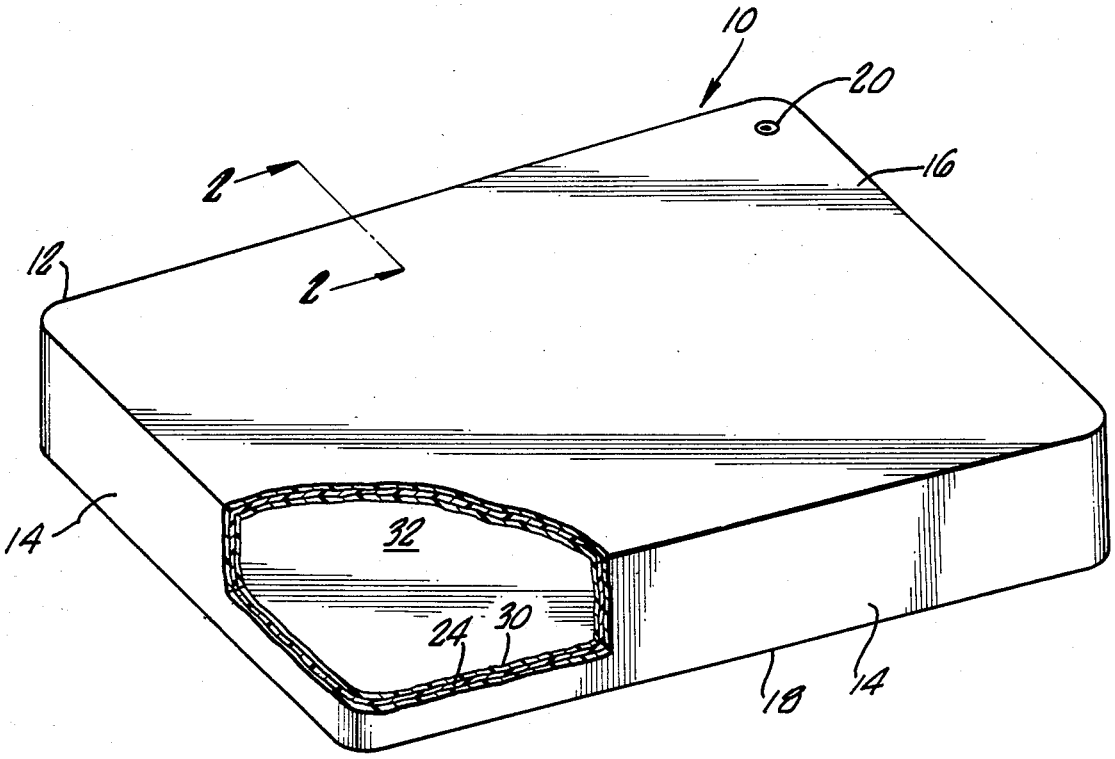

This is a continuation of application Ser. No. 134,628, filed Mar. 27, 1980, now U.S. Pat. No. 4,382,305.

BACKGROUND

This invention relates to waterbed mattress.

Waterbed mattresses are conventionally made of plasticized polyvinylchloride. Polyvinylchloride is an advantageous material to use in that it is durable, flexible, and can easily be bonded to itself by adhesives and heat for forming sheets of polyvinylchloride into the configuration of a waterbed.

However, polyvinylchloride suffers from a disadvantage. A polyvinylchloride mattress can be punctured or torn by misuse from the owner of a waterbed mattress. It is common that an owner of a waterbed mattress, forgetting that he does not have a conventional mattress, to stick a pin into the mattress, thereby causing a leak. Also, cats and other domestic animals are known to rip waterbed mattress.

There has been no solution to the problem, although attempts have been made to cure its symptoms. These attempts involve the use of exterior waterproof covers around the mattress so as to prevent leaking water from spilling onto surrounding floor surfaces. Such exterior liners are described in U.S. Pat. Nos. 3,761,974, 3,736,604, 3,742,531, 4,149,286, and 4,145,780. However, although these liners can contain leaks, they do nothing to solve the problem of a punctured waterbed mattress.

SUMMARY

The present invention is directed to a self-sealing waterbed mattress. Like the conventional waterbed mattress, the mattress of the present invention comprises a polymeric, puncturable envelope which is ordinarily made of plasticized polyvinylchloride. However, unlike the conventional waterbed mattress, the mattress is provided with an internal layer or film of a sealing material for sealing leaks in the envelope. The sealing material is a viscous, water-resistant, material that has a sufficiently high viscosity at 110° F. that it does not flow through a puncture in the envelope, but a sufficiently low viscosity at 60° F. that it can flow into a puncture in the envelope and seal the puncture against water leakage therethrough. A preferred sealing material is a polymeric material comprising polybutene uniformly filled with a particulate filler such as talc. The sealing material preferably is provided in a film of less than about 50 mils in thickness, and more preferably in a thickness of from about 5 to about 10 mils.

The sealing material can be provided as part of an internal liner assembly. The internal liner assembly comprises at least one, and preferably two, layers or sheets of a flexible, polymeric material that is substantially permanently unaffected by long-term direct contact with water such as polyethylene. The sealing material is sandwiched between the two layers of liner material when two layers are used. When one layer of liner material is used, the sealing material is between the one layer and the envelope.

By provision of the sealing material, minor punctures and rips that can occur in a waterbed mattress are automatically sealed. This prolongs the life of the waterbed mattress and prevents water from spilling onto surrounding floor surfaces. Furthermore, when the mattress is provided with a liner, the liner provides another barrier against water leakage.

DRAWINGS

Figure 2:
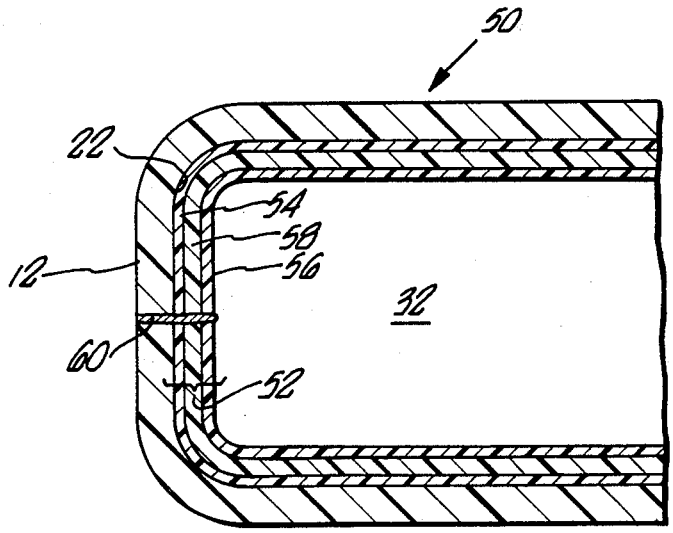

These and other features, aspects, and advantages of the present invention will become better understood with reference to the following description, appended claims, and accompanying drawings where:

FIG. 1 is a perspective view of a waterbed mattress according to the present invention; and FIG. 2 is a sectional view of another version of a waterbed mattress according to the present invention taken along a line corresponding to line 2—2 of FIG. 1.

DESCRIPTION

With reference to FIG. 1, there is shown a self-sealing waterbed mattress 10 according to the present invention. Like the conventional waterbed mattress, the waterbed mattress 10 comprises an exterior, generally rectangular enclosure or envelope 12 that defines the side 14, top 16, and bottom 18 walls of the waterbed mattress 10. The top wall or surface 16 of the waterbed mattress 10 serves as a sleeping surface and is adapted for receiving persons in sitting and reclining positions. The mattress 10 is provided with a fill valve 20, which preferably has a construction as described in copending and coassigned patent application Ser. No. 134,627, now abandoned by Charles P. Hall, filed on the same day as this application, entitled "Valve for Waterbed Mattress," which is incorporated herein by this reference.

The envelope 12 is of conventional construction and is generally formed of flexible, plasticized, polyvinylchloride. Its thickness is in the range of from about 10 to about 30 mils, and preferably about 20 mils. The envelope can be formed according to conventional techniques using adhesives and heat welding, and preferably by heat welding the seams. It can be formed by bonding two planar sheets together along their periphery or by bonding upstanding sheets between the edges of the top and bottom walls to form a contoured or fitted structure.

On the internal surface 22 of the envelope 12 is a thin film or layer 24 of a sealing material that serves to seal any leaks that form in the envelope. The sealing material is formed from a viscous, water-resistant, i.e. non-water soluble material, and preferably a polymeric material.

The sealing material serves to automatically seal punctures, rips, and the like in the envelope 12 resulting from domestic animals, pins, and nails. In order for the sealing material to function properly, it requires specific rheological properties. It needs to have a sufficiently low viscosity at room temperature, on the order of about 60° F., that it can flow into a puncture hole. However, it needs to have a sufficiently high viscosity, even at the maximum elevated operating temperatures of the waterbed, i.e., on the order of up to about 110° F., that it does not flow all the way through a puncture in the envelope.

To determine if a candidate sealing material meets these requirements, a simple test can be conducted. The sealing material is placed in a layer of about 5 to 10 mils thick between two polyethylene bags, each bag being about 4 mils in thickness. The internal bag is filled with about a quart of water at a selected temperature. Both bags are then punctured with a nail to produce a hole of about 1/16 inch in diameter. A satisfactory sealing material is one that seals the hole and prevents water from leaking out at about 60° F., but does not flow out of the hole at 110° F.

Another requirement for the sealing material is that it stays in position as a film or layer adjacent the envelope, even on vertical surfaces of the envelope. In addition, the sealing material should not adversely affect the envelope 12, or any other materials with which the sealing material comes in contact, such as a liner 30 which is described in detail below. Preferably the sealing material contains nothing that can migrate through the envelope 12 and is deleterious to the health of the user of the waterbed.

A preferred material for the sealing material is polybutene containing a particulate filler. The weight ratio of polybutene to filler preferably is from about 3:1 to about 1:5, more preferably from about 2.5:1 to about 1:1, and most preferably is about 2:1, to satisfy these rheological requirements.

In addition to polybutene, other viscous polymers that are believed to be suitable include polyisoprene, uncured polysulfides, acrylic solutions such as polymethylmethacrylate disolved in ethyl acetate, and silicone gels.

The particulate filler can be a conventional filler such as talc, diatomaceous earth, silica, calcium carbonate, clays, carbon black, mica, flint powder, quartz, cryolite, alumina, barytes, pyrophyllite, pigments, and the like.

A preferred sealing material comprises two parts by weight of polybutene, one part by weight talc, and one percent by weight cabosil, a diatomaceous earth available from Cabot Company. The talc has a number average particle size of about 15 microns. The polybutene is available from Chevron Chemical of San Francisco, Calif., under the catalog number of 128. This polybutene has a molecular weight of about 2,700, a viscosity at 210° F., SUS (ASTM D-2161) of 18,000 to 23,000, and a specific gravity, 60°/60° F. (ASTM D-287) of 0.911.

The polybutene and particulate filler can be uniformly mixed together with a high-speed rotary mixer such as a Cowles mixer.

Preferably the sealing material is provided in a film 24 of less than about 50 mils (0.050 inch), because thicker films provide little, if any, improvement in sealing and increase the weight and decrease the flexibility of the waterbed mattress. If the thickness is much less than about 5 mils, large size holes may not be automatically sealed. Thus, preferably the sealing material is provided in a layer 24 of at least about 5 mils, and preferably from about 5 to about 10 mils in thickness.

For a king-size waterbed, less than 10 pounds of sealing material are required, and generally on the order of from about 5 to about 7 pounds are required.

To maintain the sealing material in place, preferably an internal liner 30 that conforms generally to the shape of the envelope 12 is provided. The liner 30 serves to lengthen the life of the waterbed mattress 10 in two ways. First, it keeps water 32 away from the envelope 12 and thus prevents the water from adversely affecting the envelope 12. It is known that water can leach plasticizers from polyvinylchloride, which can result in the envelope 12 losing its flexibility and becoming rigid and prone to ripping and failure.

Secondly, the liner 30 serves as an additional water barrier. In order for water to leak from the mattress 10, it is necessary for a leak to form both in the liner 30 and in the exterior envelope 12. Further, in the case of pinhole leaks, the leaks need to be coincident for any appreciable quantities of water to leak onto the floor.

Preferably the liner 30 is made of a polymeric material that can easily be bonded to itself, either by adhesives, or more preferably by heat welding. Further, preferably the liner 30 is made of a flexible polymeric material that maintains its flexibility and tear resistance even with long-term contact with water, in the order of at least five years, preferably at least seven years, and more preferably at least ten years. Further, preferably the material used for the liner 30 is flexible without the use of plasticizers which can be leached by water. In addition, the liner 30 needs to be compatible with the chemicals added to the water in the waterbed mattress for preventing growth of organisms such as algae.

Another requirement for the liner 30 is that it maintains its flexibility and resistance to tear at both the operating temperature of the waterbed, which generally is on the order of about 90° F., and at low temperatures at which waterbed mattresses can be stored, i.e., in the order of 40° to 50° F.

The preferred material for the liner 30 is low, medium, or high density polyethylene. Polyethylene is a flexible, low cost, durable material that does not rely on plasticizers for its flexibility, and which can maintain its physical properties even when in contact with water for long periods of time. The polyethylene can be linear or branched and it can be modified by including rubber in the composition.

A satisfactory liner 30 has been made from a polyethylene available from Golden West Plastics, Inc., Irvine, Calif., under Catalog XP141.

Other materials which are believed to be satisfactory for forming the liner 30 include film forming nylon, polyvinyl acetate, polyvinylidene fluoride, polyvinyl butyral, polybutadiene, styrene-butadiene block copolymers such as those sold under the tradename Kraton, styrene-isoprene block copolymers such as those sold under the tradename Kraton, other polyolefins such as polypropylene, and rubbers such as neoprene, copolymers of butadiene-styrene, butyl rubbers, and copolymers of butadiene and acrylonitrile.

Preferably the liner 30 is sufficiently thick that it by itself forms a waterproof barrier. Because pinholes can form during extrusion of polyethylene sheet, preferably the liner is at least about 2 mils thick to avoid such pinholes. Preferably the liner 30 is no thicker than about 6 mils, because at thicknesses greater than about 6 mils it is difficult to heat weld with polyethylene.

Preferably the liner 30 is formed from two coextruded sheets of polyethylene, each in the order of from about 1 to about 3 mils thick, and more preferably each about 2 mils thick. This is because when the liner 30 is formed from two sheets, it is unlikely that any pinholes present would be coincident, and thus form a leak path.

The inner liner 30 has substantially the same shape as the exterior envelope 12. It has a corresponding top wall, bottom wall, and side walls. The liner 30 protects the entire interior surface of the envelope from water. The liner 30 can be formed by bonding two planar sheets of polyethylene together along their periphery or by bonding upstanding sheets between the edges of the top and bottom walls to form a contoured or fitted structure.

In the event that a hole forms in the internal liner 30, preferably the sealing material flows to seal that hole without flowing through the hole.

The waterbed mattress 10 of FIG. 1 can be formed by rolling the sealing material 24 onto the outward facing surface 56 of the polyethylene sheet used for forming the liner 30 before the polyethylene is sealed to form the liner.

In another version of the present invention, as shown in FIG. 2, the envelope 12 of a waterbed mattress 50 is provided with an internal liner assembly 52. The internal liner assembly 52 comprises two sheets or layers 54 and 56 of a liner material with a film 58 of a water-resistant, viscous, polymeric sealing material sandwiched therebetween.

This construction has advantages compared to the construction of FIG. 1. For example, the polyvinylchloride envelope 12 is protected from contacting the sealing material 58 by the outer layer 54 of liner material. The liner material preferably is made of an essentially inert material such as polyethylene. This avoids any possible problem of anything in the sealing material 58 from adversely affecting the user of the waterbed. This also avoids the sealing material having a deleterious effect on the polyvinylchloride envelope and possibly shortening the life of the polyvinylchloride envelope.

A second advantage of this construction shown in FIG. 2 is that the liner assembly 52 is easy to fabricate. All that is required is that the sealing material 58 be rolled into a desired thickness between two sheets of liner material, which can be sealed together around the peripheral edges, thus forming a bag of sealing material. Then the entire liner assembly 52, including the sealing material 58, can be placed within the envelope 12.

The film of sealing material 58 of FIG. 2 has the same properties and can be made of the same materials as the film of sealing material 24 shown in FIG. 1. Likewise, each layer 54 and 56 of liner material shown in FIG. 2 can have the same dimensions and be made of the same material and have the same properties as the liner 30 of FIG. 1.

In the version shown in FIG. 2, the two layers 54 and 56 of liner material are preferably heat sealed together in the region of the valve 20 so that the valve described in the aforementioned application Ser. No. 134,627 can be used.

FIG. 2 shows how the sealing material 58 flows to fill a hole 60 made by a sharp object such as a pin in the waterbed mattress, the hole extending through the envelope 12 and both layers 54 and 56 of liner material.

Although the present invention has been described in considerable detail with reference to certain preferred versions thereof, other versions are possible. For example, rather than using a sealing material having the rheological properties described above, the sealing material can be a material that swells when contacted by water to seal a puncture such as gelatin, starch, or sodium carboxymethyl cellulose. Alternatively, the sealing material can be a material that hardens in situ on contact with water to seal a puncture, such as an isocyanate terminated polyurethane. Alternatively, the sealing material can be a material that has the desired rheological characteristics only after contact with water.

Therefore the spirit and scope of the appended claims should not necessarily be limited to the description of the preferred versions contained herein.

What is claimed is:

1. A self-sealing waterbed mattress comprising a polymeric, flexible, puncturable envelope and a flexible internal liner separated from the envelope by a layer of viscous, water-resistant, sealing material for sealing leaks in the envelope, the sealing material at 110° F. not being capable of flowing through a puncture in the envelope and at 60° F. being capable of flowing into a puncture in the envelope and sealing the envelope against water leaks through the puncture, the layer of the sealing material being less than about 50 mils thick, wherein when water is in the mattress the water is within the internal liner.

2. The waterbed mattress of claim 1 in which the internal liner is formed of a material that is substantially permanently unaffected by long-term direct contact with water.

3. The waterbed mattress of claim 2 in which the liner comprises polyethylene.

4. The waterbed mattress of claim 1 in which the envelope comprises polyvinyl chloride.

* * * * *